United States Patent [19]

Nozaka

[11] Patent Number: 4,636,276

[45] Date of Patent: Jan. 13, 1987

[54] AUTOMATIC ADHESIVE DOUBLE COATED TAPE APPLYING DEVICE

[75] Inventor: Yoshiki Nozaka, Tokyo, Japan

[73] Assignee: Dai Nippon Insatsu Kabushiki Kaisha, Tokyo, Japan

[21] Appl. No.: 794,571

[22] Filed: Nov. 4, 1985

Related U.S. Application Data

[63] Continuation-in-part of Ser. No. 621,527, Jun. 18, 1984, abandoned.

[30] Foreign Application Priority Data

Jun. 20, 1983 [JP] Japan ..... 58-110666

[51] Int. Cl.[4] ..... B31F 5/06; B65H 21/00

[52] U.S. Cl. ..... 156/353; 156/361; 156/366; 156/506; 156/522; 156/523; 156/540; 156/577; 156/584

[58] Field of Search ..... 156/353, 361, 366, 506, 156/510, 519, 521, 522, 523, 540, 541, 577, 584, DIG. 42

[56] References Cited

U.S. PATENT DOCUMENTS

| | | | |
|---|---|---|---|
| 3,729,362 | 4/1973 | French et al. | 156/541 |
| 3,751,324 | 8/1973 | Enskat | 156/521 |
| 3,775,219 | 11/1973 | Karlson et al. | 156/526 |
| 3,992,244 | 11/1976 | Craig et al. | 156/521 |
| 4,089,730 | 5/1978 | Mahn | 156/541 |
| 4,227,960 | 10/1980 | Loeffler et al. | 156/522 |
| 4,328,061 | 5/1982 | Off et al. | 156/522 |

*Primary Examiner*—Michael Witshyn

*Attorney, Agent, or Firm*—Koda and Androlia

[57] ABSTRACT

An automatic adhesive double coated tape applying device generally comprises a base assembly constituting essential structure of the device, an assembly for supporting the base assembly to be movable in a direction toward or apart from a material to which the tape is applied, and an assembly for shifting the base assembly along the surface of the material. A composite tape consisting of a pressure sensitive adhesive double coated tape and a tape to be separated therefrom is fed from a reel member mounted on the base assembly at a cutting position at which only the adhesive double coated tape is cut. The composite tape is then fed below a flexible pressing brush by which the adhesive double coated tape is bonded on the material by a predetermined length in accordance with the movement of the base assembly along the surface of the material and the tape separated from the adhesive double coated tape is then wound around another reel member.

14 Claims, 22 Drawing Figures

AUTOMATIC ADHESIVE DOUBLE COATED TAPE APPLYING DEVICE

This is a continuation-in-part application of the U.S. patent application Ser. No. 621,527, now abandoned.

BACKGROUND OF THE INVENTION

This invention relates to a device for automatically applying an adhesive double coated tape on a material, particularly, to be used for a pasting apparatus adapted to splice a web or to paste a web on a core of a roll in a rotary press or a web windup machine.

With a known rotary press now operated, a sticking or bonding operation of old and new webs such as paper, fiber or the like wound around rolls is generally automatically carried out by a method in which a new web roll is pre-driven by a pre-driving device just before an old web roll has completely been payed out and the new and old webs are bonded at a time when peripheral, i.e. feeding, speed of the new web roll has coincided with that of the old web roll, or by a method in which a pay-out operation of the old web is stopped by an accumulator, for example, just before the old web roll has completely been payed out to thereafter bond the old and new web rolls.

In these methods, however, is required an operation or working to paste both of the old and new web rolls or to bond an adhesive double coated tape on one or both of the old and new web rolls. This pasting or bonding operation is usually performed manually in the known methods.

SUMMARY OF THE INVENTION

An object of this invention is to improve disadvantages of prior art devices and provide an automatic tape applying device to be used for a rotary press, for example, in which an adhesive double coated tape is automatically applied to a web roll at a time when a new web roll will be spliced to an old web roll before the old web roll has completely been payed out in a web splicing operation.

Another object of this invention is to provide an adhesive tape applying device in which the adhesive double coated tape is accurately bonded on the surface of the web roll in spite of the wrinkled surface condition thereof by a predetermined length.

A further object of this invention is to provide an adhesive tape applying device in which guide roller means are disposed so that the leading end of the adhesive double coated tape of the composite tape is not changed before and after the movement of the tape pressing member.

According to this invention for achieving these and other objects, there is provided a device for automatically applying an adhesive double coated tape to a desired material such as a web roll in a rotary press in which during a feeding operation of a composite tape consisting of an adhesive double coated tape and a tape laminated thereto so as to be separated therefrom only the adhesive double coated tape is linearly applied on the desired material by a predetermined length, the device being characterized in that the device comprises a base assembly, an assembly for supporting the base assembly to be movable in a direction toward and away from the desired material, and an assembly for shifting the supporting assembly together with the base assembly in a direction such that the base assembly is moved along the surface of the desired material. The base assembly comprises a frame member connected to the supporting assembly, a member mounted on the frame member for feeding and holding a roll mounted on a rotating shaft thereof around which the composite tape is wound so as to feed the composite tape, a member mounted on the frame member for guiding and feeding only a tape separated from the composite tape, a member for pressing the adhesive double coated tape separated from the composite tape against the desired material so that the adhesive exposed surface of the adhesive double coated tape is linearly bonded under pressure of the pressing member onto the surface of the desired material between the composite tape feeding member and the separated tape guide member when the base assembly approaches closely to the desired material, the pressing member being supported by the base assembly to be vertically movable relative thereto, a cutting assembly located between the composite tape feeding member and the pressing member for cutting only the adhesive double coated tape of the composite tape without cutting the tape to be separated therefrom after the adhesive double coated tape with the adhesive exposed surface has been applied on the desired material by a length determined by the movement of the base assembly along the surface of the desired material, the cutting assembly comprising a cutter knife, a cutter knife support member movably supported by the base assembly, a drive member for moving the cutter knife support member, and a cutter knife receiving member supported by the frame member around which the composite tape passes through a position opposite to the front end of the cutter knife, a member for braking the rotation of the rotating shaft of the composite tape feeding member after the adhesive double coated tape has been cut by the cutting assembly, an element for detecting an end surface of the desired material to control the travelling of the base assembly, a member for operating the braking member so that when the cut portion of the composite tape reaches the central portion of the pressing member, the braking member is operated by a timer operated in connection with the cutting operation of the cutting assembly, and an element for actuating and guiding the pressing member in operative relation to the cutting assembly and detecting element so that the adhesive double-coated tape of a desired length can be applied on the desired material, the guide member for guiding and feeding the support tape cut and separated from the composite tape comprising at least one movable guide roller which is disposed to be movable together with the pressing member and around which the separated support tape is wound, a winding reel rotatably mounted on a rotating shaft supported by the frame member, and a stationary guide roller located between the movable guide roller and winding reel at such a position that a length of the separated tape stretched between the movable and stationary guide rollers is not changed before and after the pressing movement of the pressing member.

Moreover, according to this invention, a flexible pressing member is used for applying a pressure sensitive adhesive double coated tape to a material, so that the tape can accurately and uniformly be applied on the material under pressure regardless of the surface condition of the material. In addition, since the adhesive double coated tape is completely cut and separated from the composite tape after the leading end thereof is bonded to the material, the cut tape is not adversely affected by the composite tape, for example a tension or pulling force thereof.

DESCRIPTION OF THE PREFERRED EMBODIMENT

Figure 1:
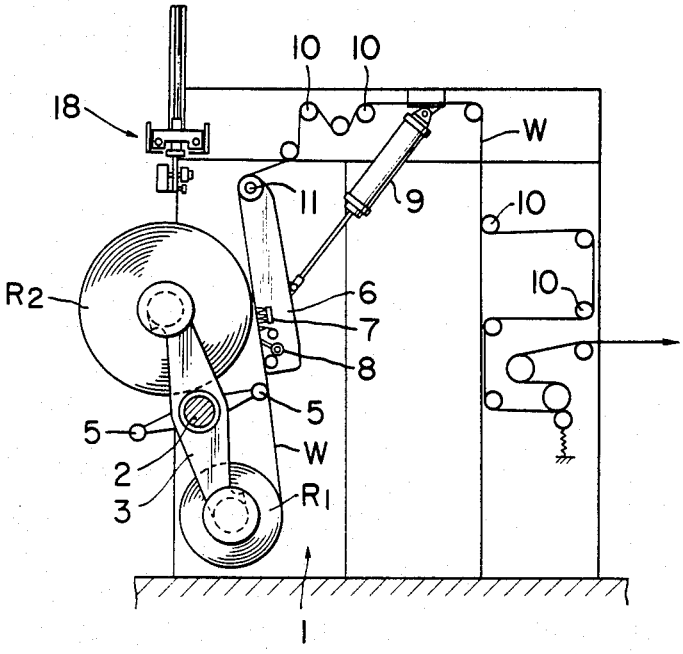
FIG. 1 is a schematic side view, partially eliminated, of a web feeding device of a rotary press provided with a device for automatically applying an adhesive double coated tape according to this invention.

A web feeding device of a rotary press provided with a device for automatically applying an adhesive double coated tape to a web according to this invention will now be described with reference to FIGS. 1 and 2.

The web feeding device comprises a frame 1, in which a shaft 2 is rotatably supported to extend laterally. A pair of web feeding arms 3 are secured to the shaft 2 in a spaced apart relation. An electric motor 4 is coupled to the shaft 2 through a speed reduction mechanism 4*a*. A pair of web winding rolls R1 and R2 are supported freely rotatably and freely replaceably between two ends of the pair of arms 3. Old web is wound around the roll R1, while new web is wound around the roll R2. Each arm 3 has a pair of projections projecting perpendicularly from a central part thereof. A pair of guide rollers 5 are rotatably supported by the outer ends of the projections. As is well known in the art, the web W such as paper, fiber or the like payed out of the roll R1 is caused to pass nearby a flexible pressing member 7 such as a brush in the preferred embodiment and a knife 8 supported by a web splicing arm 6, and is sent out of the web feeding device through the guiding of a series of guide rollers 10. When a pneumatic cylinder assembly 9 is contracted, the web splicing arm 6 is rotated in the counter-clockwise direction toward a normal position remote from the web W. However, when the old web W is to be spliced with a new web, the arm 6 is rotated by the expansion of the cylinder assembly 9 to a position shown in FIG. 1, where the pressing brush 7 depresses the old web payed out of the old web winding roll R1 toward the new web payed out of the new web winding roll R2, and the knife 8 cuts off an end portion of the old web when the old web has been spliced with the new web.

Figure 2:
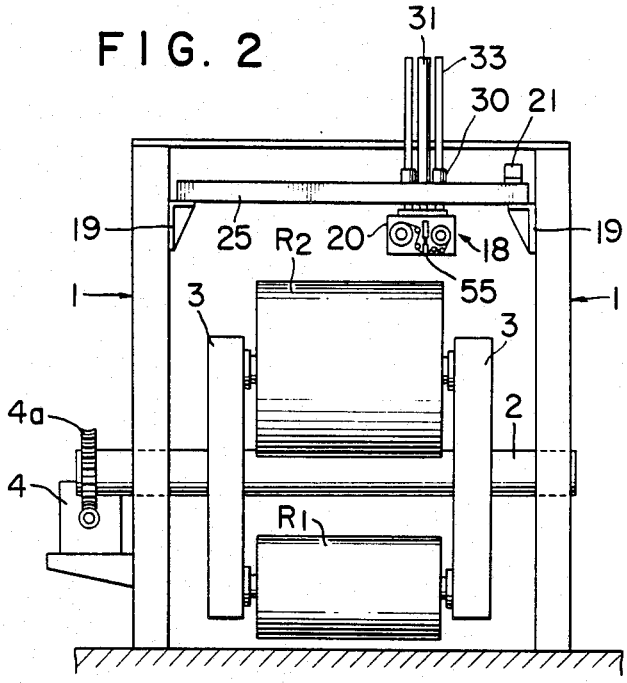
FIG. 2 is a front view of the web feeding device shown in FIG. 1.

An automatic tape applying device according to this invention, which is generally designated by a numeral 18 in FIGS. 1 and 2, is supported by the frame 1 to be movable laterally within an upper part of the same.

Figure 3:
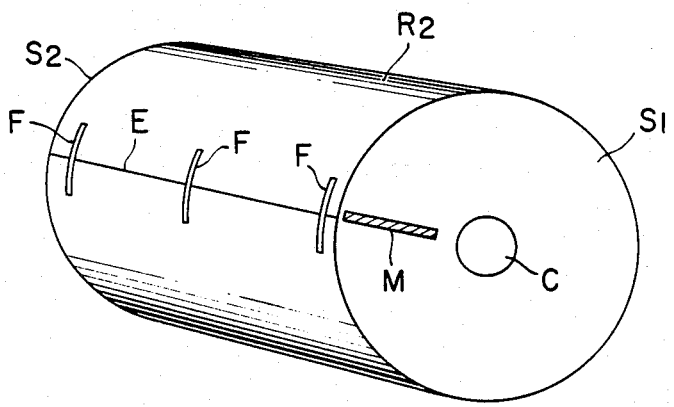
FIG. 3 is a perspective view of a new web roll.

FIG. 3 illustrates an example of the new-web winding roll R2, which comprises a core C, around which the new web is wound. A leading end edge E of the web wound around the roll R2 is held in its position by using adhesive tapes F for preventing the end edge E from being released. An appropriate mark M is marked on the end surface S1 of the roll R2 for the purpose of detecting angular position of the roll R2.

Figure 4:
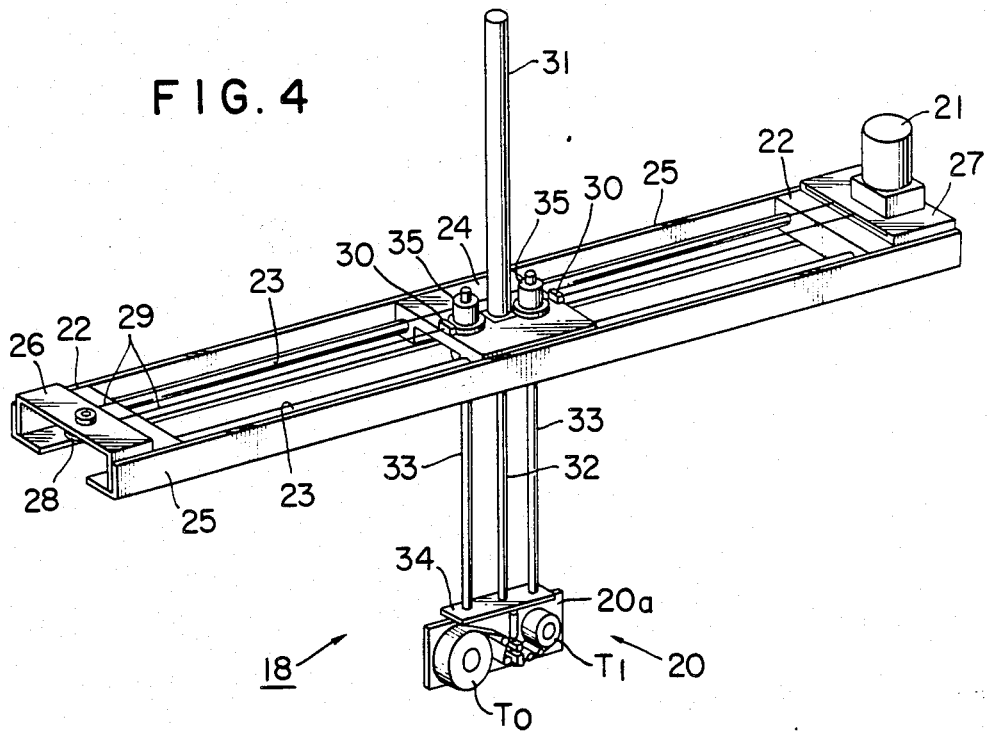
FIG. 4 is also a perspective view of the device for automatically applying an adhesive double coated tape according to this invention.

FIG. 4 illustrates a detailed construction of the automatic tape applying device 18. The device 18 comprises two laterally extending shafts 23, outer ends of which are secured together by means of end members 22. A block 24 is slidably mounted on the two shafts 23. The end members 22 are combined with each other by a pair of reinforcing members 25 extending along the sides of the shafts 23 so that a frame-like structure is thereby formed. A pair of brackets 19 secure the frame-like structure to the frame 1 as shown in FIG. 2.

To the end members 22 provided on the left and right sides, as viewed in FIG. 4, of the automatic tape applying device 18 are secured a pulley supporting member 26 and a motor supporting member 27 which support a pulley 28 and an electric motor 21, respectively. A wire rope 29 is extended around the driving shaft of the motor 21 and the pulley 28. One end of the wire rope 29 is secured to the block 24 by a clamp 30 and the like. The block 24 is shifted rightward and leftward along the shafts 23 by the forward and reverse rotations of the motor 21.

A pneumatic cylinder assembly 31 extending vertically is fixedly mounted on the slidable block 24. A piston rod 32 reciprocatable in the cylinder 31 extends downwardly from the block 24, the lower end of the piston rod 32 supporting a base assembly 20 comprising essential members of a tape applying device described in detail hereinafter via a supporting member 34. A pair of bearing blocks 35 are also secured to the block 24. A pair of rods 33 extending upward from the supporting member 34 pass through the bearing blocks 35 for guiding the vertical movement of the base assembly 20 provided at the lower end of the piston rod 32.

Figure 5:
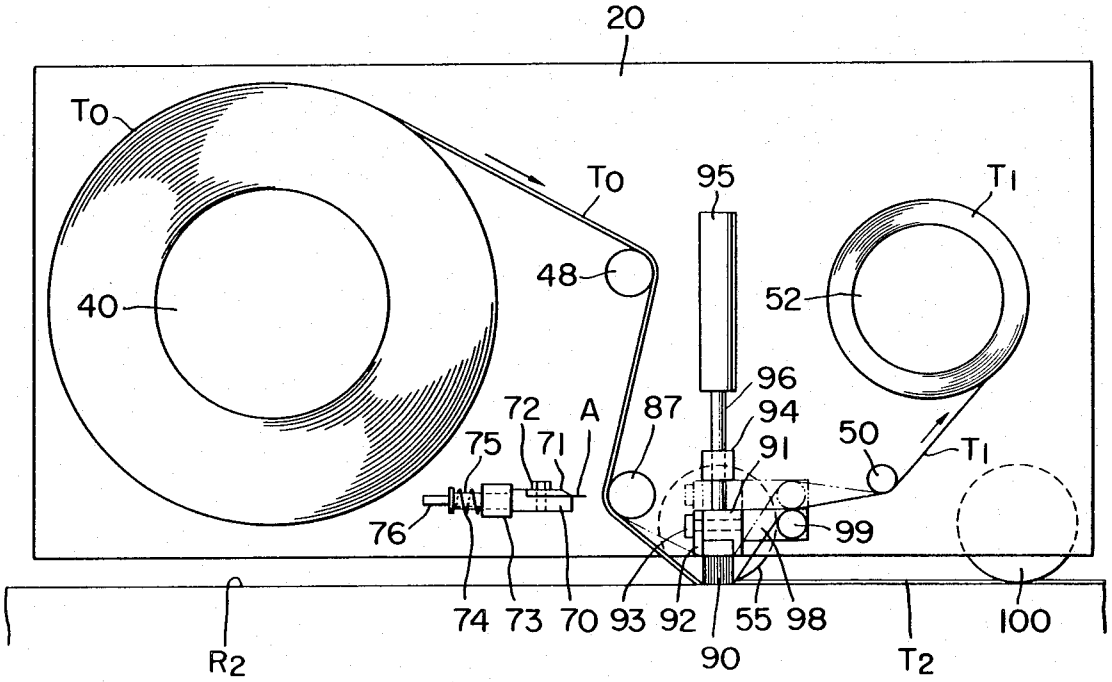
FIG. 5 is a front view of a main part of the device shown in FIG. 4.
Figure 6:
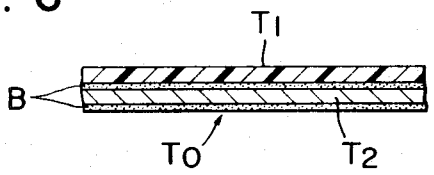
FIG. 6 is a cross section of a composite tape double coated with an adhesive.

The frame member 20*a* of the base assembly 20 is made of a metal plate disposed vertically. As shown in FIG. 5 on an enlarged scale, a reel 40 for supplying a composite tape $T_0$ is provided on one side of the base assembly 20. As shown in FIG. 6 in detail, the composite tape $T_0$ comprises a pressure sensitive double coated adhesive tape $T_2$ having a substrate coated with pressure sensitive adhesive layers B on the upper and lower side surfaces thereof, or a substrate made of non-woven fabric impregnated by an adhesive agent, and a tape $T_1$ such as paper applied on one side thereof in a separable manner. A tape winding reel 52 is provided on the same side of the frame member 20*a* at a position spaced apart from the reel 40.

The composite tape $T_0$ payed out of the tape supplying reel 40 in an arrowed direction is fed downwardly under the guide of a guide roller 48 and a cutter knife receiving roller 87. It is preferable to construct the roller 48 as silicone roller for preventing adhesion of the composite tape $T_0$ to the roller. The composite tape $T_0$ is thus caused to pass below a flexible brush 90 that depresses the tape $T_0$ downwardly. The paper tape $T_1$ stripped from the composite tape $T_0$ is sent toward the winding reel 52 around a stationary guide pin or roller 50. On the other hand, the double coated adhesive tape $T_2$, with the adhesive coated surface exposed, is applied to the surface of a material (such as the newly supplied web from the roll R2) as described hereinlater in more detail.

Figure 7:
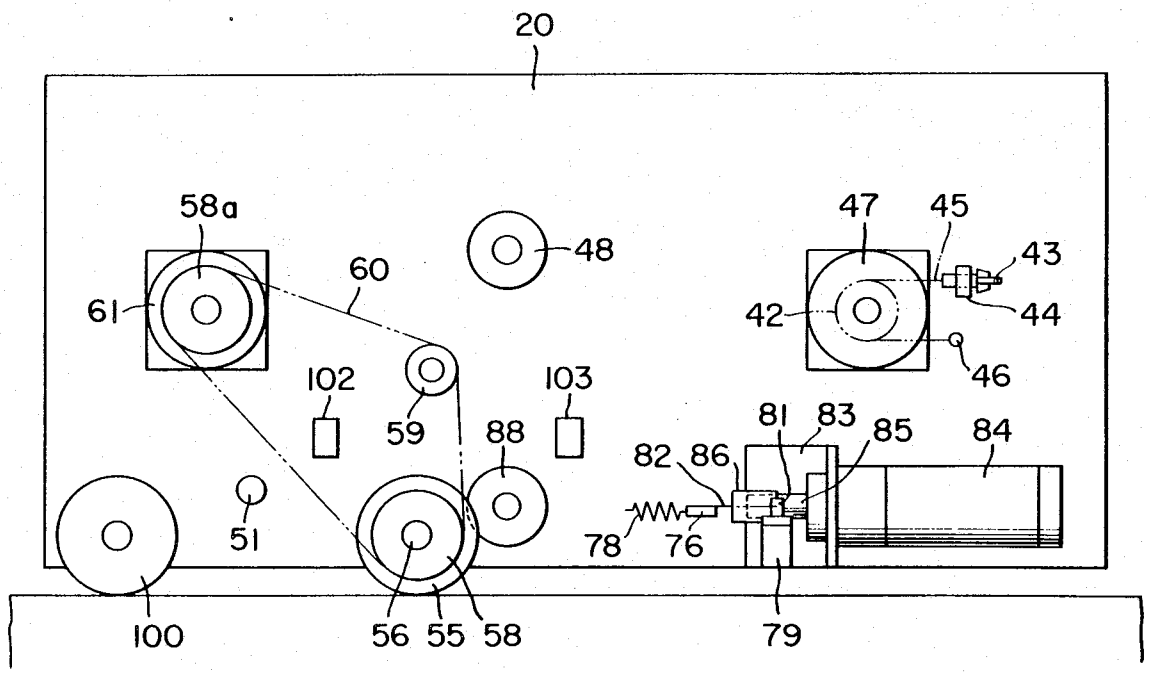
FIG. 7 is a back view of the base assembly of the device shown in FIG. 4.
Figure 8:
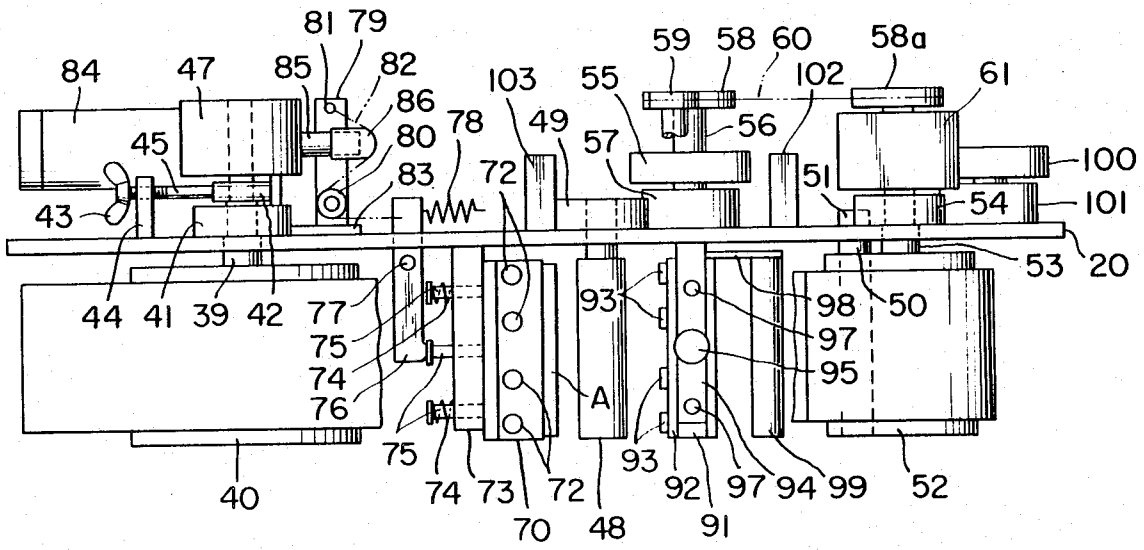
FIG. 8 is a plan view of the base assembly of the device shown in FIG. 4.

In FIGS. 7 and 8 showing the rear side and a top plan view of the base assembly 20 as viewed from the upper side of FIG. 5, the shaft 39 of the tape supply reel 40 is rotatably supported by a bearing member 41 secured to the rear side of the frame member 20*a* of the base assembly 20. An electromagnetic brake 47 is provided to exert a braking force onto the rearwardly extending portion of the shaft 39. The electromagnetic brake 47 is supported by a supporting member, not shown, provided on the rear side of the base assembly 20. Furthermore, a drum 42 is fixedly mounted on the shaft 39. Around the drum 42 is wound a leather band 45, one end 46 of which is secured to the frame member 20*a*. The other end of the leather band 45 is connected to an adjustable screw 43 driven through a supporting member 44 secured to the frame member 20*a*. By adjusting the position of the adjustable screw relative to the supporting member 44, the force exerted by the leather band 45 around the surface of the drum 42, and hence the resistance against the feeding of the composite tape $T_0$ can be adjusted as desired. The adjustment of the feeding resistance adjusts the tension of the tape $T_0$.

A bearing 57 (see FIG. 8) provided in a lower part on the rear side of the base assembly 20 freely rotatably supports a shaft 56 of a wheel 55. The wheel 55 partly projects downwardly from the lower edge portion of the base assembly 20. The projecting part of the wheel 55 is brought into contact with the web that is wound around the web winding roll R2 and is rotated when the automatic tape applying device 18 is to be moved relative to the web. A pulley 58 is further provided to be fixedly mounted on the shaft 56.

The tape winding reel 52 is secured to a shaft 53 which is rotatably supported by a bearing member 54 secured to the rear side of the base assembly 20. A pulley 58*a* is secured to an end of the shaft 53 away from the base assembly 20. A belt 60 is extended around the afore-mentioned pulley 58 and the pulley 58*a*. A tension pulley 59 is further provided for adjusting the tension of the belt 60. The winding reel 52 is rotated on the front side of the base assembly 20 in accordance with the rotation of the wheel 55.

As shown in FIG. 5, a cutter knife A is located at a position opposite to the cutter knife receiving roller 87 around which the composite tape $T_0$ passes. The cutter knife A is secured to a knife holder 70 by means of a knife clamping plate 71 and bolts 72. Pins 75 formed integrally with the knife holder 70 pass through a supporting projection 73 secured to the frame member 20, so that the pins 75 are freely slidable relative to the supporting projection 73. As is apparent from FIG. 8, the supporting projection 73 has a relatively long length, through which the pins 75, three in the shown example, are caused to pass slidably. Coil springs 74 are extended around the respective pins 75, integrally formed with the knife holder 70, between the supporting projection 73 and flanges formed integrally at the ends of the pins 75. By the coil springs 74, the cutter knife A is retracted leftward as viewed in FIG. 8 until the knife holder 70 abuts against the supporting projection 73.

An end of a pressing lever 76 abuts against the rear end of the central pin 75 and the pressing lever 76 is pivotally supported by a pivot pin 77 provided on a portion projecting from the frame member 20*a* of the base assembly 20. Through an opening, not shown, provided in the frame member 20*a*, one part of the pressing lever 76 projects into the rear side of the base assembly 20. A tension spring 78 is provided between an end of the rearwardly projecting part of the pressing lever 76 and a projection, not shown, projecting from the frame member 20*a* so that the pressing lever 76 is rotated counterclockwisely as viewed in FIG. 8 against the force of the tension spring 78.

As is apparent from FIG. 8, a supporting member 79 projects rearwardly from the frame member 20*a* of the base assembly 20 and an end of a wire rope 82 is secured to a pin 81 provided at the rear end of the supporting member 79. The wire rope 82 is extended around an end of an attachment 86 described hereinlater in more detail and around a pulley 80 rotatably mounted on the supporting member 79 and another end of the wire rope 82 is secured to the end of the pressing lever 76 secured to the tension spring 78.

A pneumatic cylinder assembly 84 is supported by a supporting member 83 secured to the rear side of the base assembly 20. The aforementioned attachment 86 is secured to an end of a piston rod 85 reciprocatable in the pneumatic cylinder assembly 84. When the piston rod 85 moves rightward, the attachment 86 pushes the wire rope 82 to the right as viewed in FIG. 8 thereby to cause the pressing lever 76 to rotate counterclockwisely around the pivot pin 77. The rotation of the pressing lever 76 urges the central pin 75 rightward thereby shifting the cutter knife A held by the knife holder 70 toward the knife receiving roller 87.

Figure 17A:
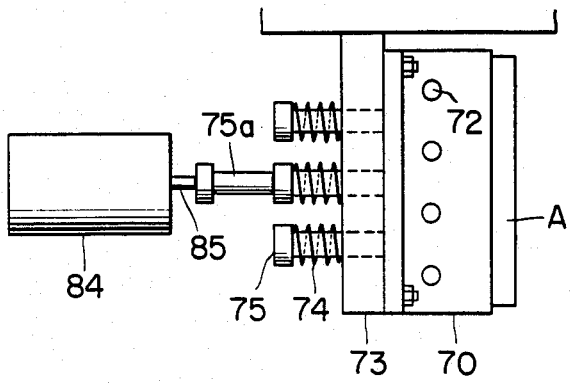
FIGS. 17A and 17B are plan and side views, respectively, showing one preferred modification of cutting knife drive means according to this invention.
Figure 17B:
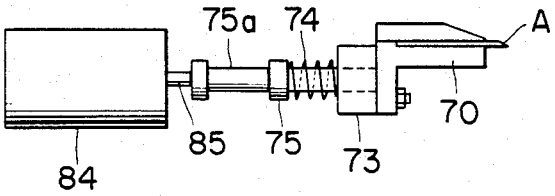

In another preferred embodiment, the piston rod 85 of the air cylinder 84 may be directly or indirectly through a pressing rod member 75*a* abutted against the central pin 75 in place of through the pressing lever 76 as briefly shown in FIGS. 17A and 17B, in which like reference numerals are added to elements or members corresponding to those shown in FIG. 8 and the air cylinder 84 in FIG. 17A or 17B is driven by substantially the same manner as described with reference to FIG. 8. According to this embodiment, the cutter knife A is more evenly pressed rightwardly as viewed in FIGS. 17A and 17B even when a cutter knife with relatively wide width is used.

A depressing brush 90 is secured to a brush holder 91 by means of a brush securing plate 92 and a plurality of bolts 93. The brush holder 91 is in turn secured to the lower end of a piston rod 96 provided in a pneumatic cylinder assembly 95 secured to the front side of the base assembly 20 as shown in FIG. 5. The piston rod 96 is slidably supported by a supporting member 94 secured to the front surface of the base assembly 20. An arm 98 extends rightwardly from the brush holder 91 for supporting a movable guide pin or roller 99. The tape $T_1$ stripped out of the double coated adhesive tape $T_2$ passing underside of the depressing brush 90 is sent around the tape winding reel 52 under the guide of the guide pins 99 and 50.

On the rear side of the base assembly 20, a bearing 101, see FIG. 8, is further provided in a lower part thereof and an auxiliary wheel 100 is rotatably supported by the frame member 20*a* of the base assembly 20 through the bearing 101. In addition, photoelectric tubes 102 and 103 are provided on the rear side of the base assembly 20 for detecting end surfaces S1 and S2 of the web roll as shown in FIGS. 7 and 8.

The afore-mentioned cutter knife receiving roller 87 comprises a core $r_1$ and a highly resilient layer $r_2$, such as a rubber layer, provided around the core $r_1$.

Operation of the device for automatically applying an adhesive double coated tape on a web roll according to this invention will be described hereunder particularly in conjunction with FIGS. 10 through 16.

After the new web roll R2 has been mounted to the web feeding arm 3, the motor 4 is driven thereby to rotate the shaft 2 of the arm 3 to bring about the web roll R2 below the automatic tape applying device 18. In this state, the new web roll R2 maintains the condition shown in FIG. 3 and the tape applying device 18 keeps a position shown in FIG. 2.

In the positional relationship of the web roll R2 and the tape applying device 18 as described above, the pneumatic cylinder assembly 31 is actuated and the base assembly 20 of the tape applying device 18 is lowered by the self-gravity to a position at which the wheel 55 comes into contact with the surface of the new web roll R2 as shown in FIG. 2. The rotation of the new web roll R2 has been stopped up to this time by the detection of the mark M marked on the end surface thereof.

Figure 10:
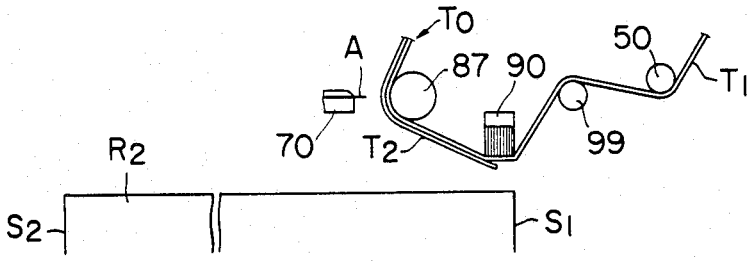
FIGS. 10 through 15 operational views for showing a series of the tape feeding and applying processes.
Figure 11:
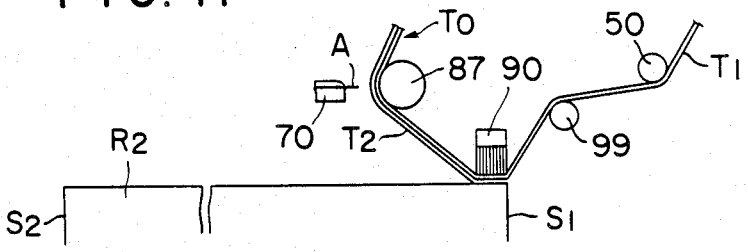
Figure 12:
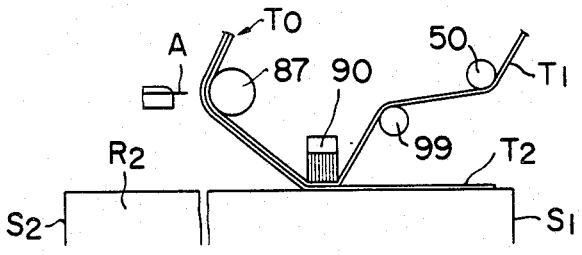

The motor 21 is then driven to travel the running block 24 through the wire rope 29, and accordingly, the base assembly 20 shifts on and along the surface of the new web roll R2 through the rotation of the wheel 55 mounted on the frame member 20*a* of the base assembly 20. At this time, since the electromagnetic clutch 61 of the winding reel 52 is in "off" state, the winding reel 52 does not rotate. Upon detecting the end surface S1 of the new web roll R2 by the phototube 102, the signal from the phototube 102 is transmitted to stop the operation of the motor 21 thereby to stop the travelling of the running block 24 i.e. the base assembly 20 of the tape applying device 18. At this time, the front end of the adhesive double coated tape $T_2$ is positioned at substantially the central portion of the pressing brush 90 as shown in FIG. 10.

The switching of the electromagnetic clutch 61 to "on" state actuates the pneumatic cylinder assembly 99 through the coupling of the shaft 53 of the winding reel 52 and the shaft of the pulley 58*a* thereby to lower the pressing brush 90 by the predetermined distance and push it against the surface of the new web roll R2. At this time, since the guide pin 99, which is located to a position so that the path between the guide pin 50 and the brush 90 does not change, also lowers, the front end of the pressure sensitive tape $T_2$ double coated with the adhesive keeps its position. The lowering of the pressing brush 90 requires the pay-out of the composite tape $T_0$ double coated with the adhesive from the feeding reel 40, but the pay-out operation of the tape $T_0$ can be smoothly performed by the amount corresponding to the change of the path for the reason that the shaft 39 of the feeding reel 40 is not braked by the electromagnetic brake 47.

Figure 18A:
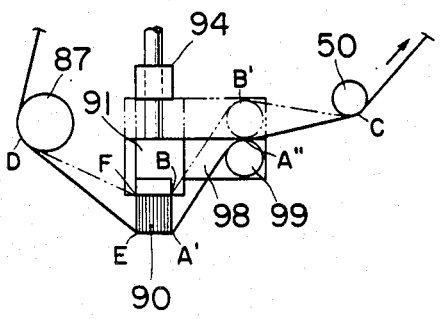
FIG. 18A shows a sketch of a part of the device of this invention.
Figure 18B:
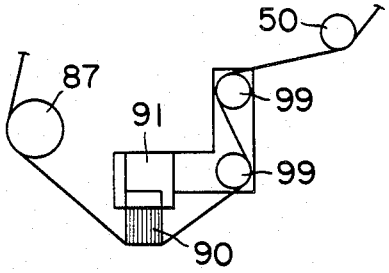
FIG. 18B is a sketch showing one modification of FIG. 18A.

Namely, the above operation is explained in detail with reference to FIG. 18A which is a part of FIG. 5. As can be understood from FIG. 18A, the location of the guide pin or roller 99 is predetermined so that the distance A'–A" between the front end of the brush 90 and the guide roller 99 is not changed i.e. equal to the distance B-B' therebetween at which the electromagnetic clutch 61 is "off" state i.e. before the lowering of the brush 90, and that the distance A"-C between the movable guide roller 99 and the stationary guide roller 50 is equal to the distance B'-C therebetween before the lowering of the brush 90. Accordingly, only the tape $T_0$ having a length corresponding to the difference between the distance DE and the distance DF is payed out, in which the distance DE equals to that between the knife receiving roller 87 and the front end of the brush 90 after the lowering thereof and the distance DF equals to that therebetween before the lowering of the same. Consequently, the leading end of the tape is not changed before and after the tape bonding operation and the predetermined length of the tape $T_2$ is always bonded. This is one significant feature of this invention. Furthermore, according to a preferred embodiment, although a plurality of guide pins or rollers 99 can be located, FIG. 18B briefly shows one example in which two guide rollers 99 are located so as to make compact the structure of the device. In this example, it is of course predetermined that the guide roller 50 is located at such a position that the distance between the movable and stationary guide rollers 99 and 50 is not changed before and after the lowering of the brush 90.

At the next step, the motor 21 is again driven to pull the running block 24 through the wire rope 29, thus shifting the base assembly 20 along the web edge E of the surface of the new web roll R2. At this step, the wheel 55 rotates and the winding reel 52 also rotates through the rotations of the pulleys 58 and 58*a*, so that the tape $T_1$ is separated from the adhesive double coated tape $T_2$ at the position below the pressing brush 90 and wound up around the tape winding reel 52. The adhesive double coated tape $T_2$ now having an adhesive exposed surface is stuck on the surface of the new web roll R2 by the pressure of the pressing brush 90 as the tape applying device 18 advances. The tape $T_2$ can strictly be bonded on the web roll R2 even if the surface of the web roll R2 were wrinkled because of the pressure of the brush 90.

Figure 9:
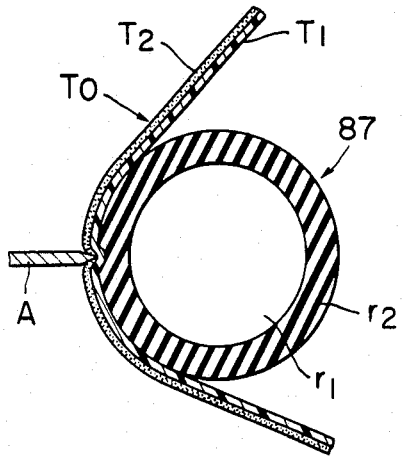
FIG. 9 is an enlarged view showing relationship between a cutting knife and a support roller.
Figure 13:
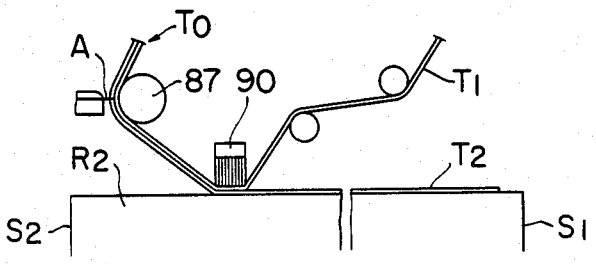

When the phototube 103 located on the frame member 20*a* of the base assembly 20 detects the other end surface S2 of the new web roll R2 during the bonding operation of the adhesive double coated tape $T_2$, the motor 21 stops and the base assembly 20 then stops at a position shown in FIG. 13. The pneumatic cylinder assembly 84 then actuates to pull the wire rope 82, and in turn, the pressing lever 76 presses the pin 75 thereby to press the cutter knife A against the roller 87 around which the composite tape $T_0$ is supported as shown in FIG. 13. This condition is illustrated in detail in FIG. 9, in which the cutter knife A only cuts the adhesive double coated tape $T_2$ and not the tape $T_1$ for the reason that the outer layer $r_2$ of the roller 87 is made of a highly resilient material so that the tape $T_1$ to be stripped from the tape $T_2$ thereafter is indented into the resilient outer layer $r_2$ of the roller 87 by the pressure of the knife A.

Figure 14:
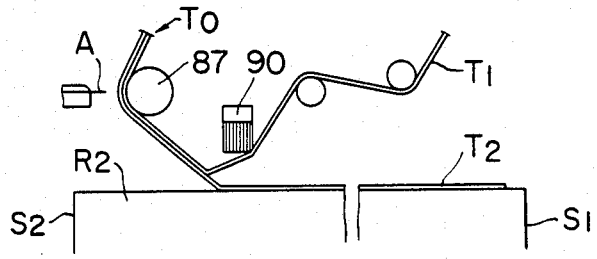

As shown in FIG. 14, after the cutting operation of the cutter knife A, the actuation of the cylinder assembly 86 stops and the cutter knife A is retired by the operation of the compression coil springs 74. At this time, the pressing brush 90 is raised and the base assembly 20 is further moved by the drive of the motor 21.

Figure 15:
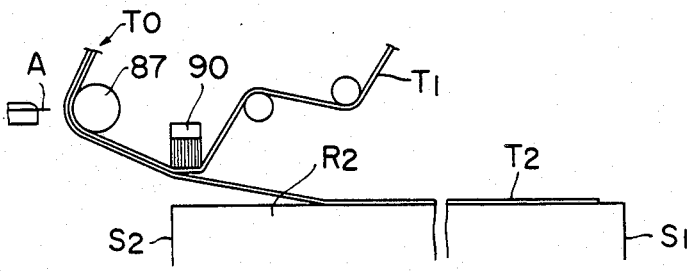
Figure 16:
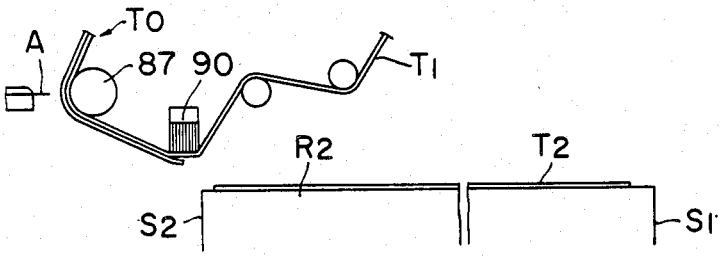
FIG. 16 is a view, similar to FIGS. 10 through 15, showing the completed condition of the tape applied to a web roll.

When the composite tape $T_0$ subjected to the butting operation is fed to the central position below the pressing brush 90 as shown in FIG. 15, the electromagnetic brake 47 is actuated in response to the operation of the timer which starts the counting of time in connection with the cutting operation of the cutting knife A thereby to lock the shaft 39 of the feeding reel 40 and finally to stop the feeding of the composite tape $T_0$ adhesive double coated. However, in spite of this fact, as the base assembly 20 of the tape applying device 18 has been linearly travelled successively along the surface of the web roll, the adhesive double coated tape $T_2$ of the advancing side of the cut portion is separated from the tape $T_1$ while the bonded adhesive double coated tape $T_2$ remains on the new web roll R2 as shown in FIG. 16. The timer is then operated to stop the motor 21 at the predetermined time after the operation of the electromagnetic brake 47 thereby to stop the travelling of the base assembly 20.

The pneumatic cylinder assembly 31 then actuates to raise the base assembly 20 and stop the same at the uppermost position. The motor 21 is reversely driven to shift the base assembly 20 backwardly to the original waiting position as shown in FIG. 2 when the motor 21 is stopped by the operation of a limit switch, not shown.

An auxiliary wheel 100 serves to hold the base assembly 20 of the tape applying device 18 on the new web roll R2 and prevent it from falling down at a time when the wheel 55 reaches the surface end portion of the new web roll R2.

Figure 19:
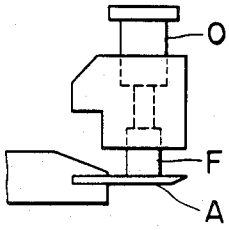
FIG. 19 is a sketch showing one example of an oil supplying means for a cutting knife.
Figure 20:
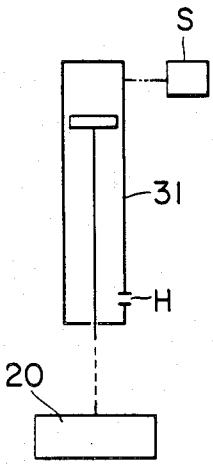
FIG. 20 is also a sketch for showing a speed control for a base assembly of the device of this invention.

In an embodiment of a practical device for automatically applying an adhesive double coated tape to a desired material according to this invention, additional auxiliary members or elements may advantageously be disposed, for example, as briefly shown in FIGS. 19 and 20. FIG. 19 illustrates an oil supplying means operated in association with a tape cutting knife A and the oil supplying means essentially comprises an oil cup O and a felt material F to which the oil will be permeated from the oil cup O. The oil through the felt material F is applied on the surface of the knife A when the knife A is reciprocated, thereby to prevent the composite tape $T_0$ after being cut from adhering to the knife surface when the knife is retired backwardly. FIG. 20 is a sketch showing the pneumatic cylinder assembly 31 to which a speed controller S is operatively attached. The lowering and elevating of the base assembly 20 is managed by supplying or releasing a gas, usually air, to or from the cylinder 31 through an exhaust hole H and the lowering or elevating speed is controlled by the speed controller S.

In the embodiment described hereinbefore, although the tape applying device is used for bonding the adhesive double coated tape on the web roll for a rotary press, this invention can of course be used for applying the adhesive double coated tape on a material other than the web roll such as paper, fiber or the like. Moreover, a flexible pressing member other than pressing brush such as resilient rubber member can be used.

It will be understood that this invention is not to be limited by the details given herein but that it may be modified within the scope of the appended claims.

What is claimed is:

1. A device for automatically applying an adhesive double coated tape to a desired material comprising:

a base assembly constituting an essential structure of the adhesive double coated tape applying device;

means for supporting said base assembly to be movable in a direction toward or away from said desired material; and means for shifting said supporting means together with said assembly in a direction such that said base assembly is moved along the surface of said desired material, said base assembly comprising:

a frame member connected to said supporting means;

means mounted on said frame member for feeding and holding a roll mounted on a rotating shaft thereof around which a composite tape consisting of an adhesive double coated tape and a support tape laminated thereto to be separable therefrom is wound so as to feed said composite tape;

means mounted on said frame member for guiding and feeding only said support tape separated from said composite tape;

means for pressing said adhesive double coated tape separated from said composite tape against said desired material so that the adhesive exposed surface of said adhesive double coated tape is linearly bonded under pressure of said pressing means onto the surface of said desired material between said composite tape feeding means and said separated support tape guide means when said base assembly approaches closely said desired material, said pressing means being supported by said base assembly to be movable relative thereto;

means located between said composite tape feeding means and said pressing means for cutting only said adhesive double coated tape of said composite tape without cutting said support tape to be separated therefrom after said adhesive double coated tape with the adhesive exposed surface has been applied on said desired material by a length determined by the movement of said base assembly along the surface of said desired material, said cutting means comprising a cutter knife, a cutter knife support member movably supported by said base assembly, means for moving said cutter knife support member, and a cutter knife receiving member supported by said frame member around which said composite tape passes through a position opposite to the front end of said cutter knife;

means for braking the rotation of said rotating shaft of said composite tape feeding means after said adhesive double coated tape has been cut by the cutting means;

means disposed on said frame member for detecting an end surface of said desired material to control travelling of said base assembly;

means for operating said braking means so that when the cut portion of said composite tape reaches the central portion of said pressing means, said braking means is operated by a timer operated in connection with the cutting operation of said cutting means thereby to stop the feeding of said adhesive double coated tape; and means for actuating and guiding said pressing means in operative relation to said cutting means and detecting means so that the adhesive double coated tape of a desired length can be applied on the desired material, said means for guiding and feeding said support tape cut and separated from said composite tape comprising at least one movable guide roller which is disposed to be movable together with said pressing means and around which said separated support tape is wound, a winding reel rotatably mounted on a rotating shaft supported by said frame member, and a stationary guide roller located between said movable guide roller and said winding reel at such a position that a length of said separated support tape stretched between said movable guide roller and said stationary guide roller is equal before and after the pressing movement of said pressing means.

2. The device according to claim 1 wherein said frame member comprises a metal plate member.

3. The device according to claim 1 wherein said pressing means comprises a flexible pressing brush.

4. The device according to claim 1 wherein said rotating shaft for said separated support tape winding reel is operatively connected through a transmission mechanism to a wheel member secured to said frame member and rolled on and along the surface of said material when said base assembly moves along said material.

5. The device according to claim 1 wherein said cutter knife receiving member comprises a support roller consisting of a core member and a resilient member disposed around said core member.

6. The device according to claim 1 wherein said composite tape feeding means comprises a tape supply reel and a guide roller made of a silicone member.

7. The device according to claim 1 wherein said braking means comprises an electromagnetic brake mounted on said frame member.

8. The device according to claim 1 wherein said cutter knife support member moving means comprises a pneumatic piston-cylinder assembly the piston rod of which is operatively connected to said cutter knife support member.

9. The device according to claim 8 wherein said piston rod is directly connected to said cutter knife support member.

10. The device according to claim 8 wherein said piston rod is connected to said cutter knife support member through a pressing lever operatively connected to said piston rod.

11. The device according to claim 1 wherein said adhesive double coated tape cutting means includes means for feeding oil on the surface of said cutter knife.

12. The device according to claim 1 wherein said base assembly is shifted under the control of the shifting means.

13. The device according to claim 1 wherein said desired material is a web roll used for a rotary press.

14. The device according to claim 1 wherein said adhesive double coated tape is a pressure sensitive adhesive double coated tape.

* * * * *